US005666621A

United States Patent [19]

Maekawa et al.

[11] Patent Number: 5,666,621

[45] Date of Patent: Sep. 9, 1997

[54] SHEET SEPARATION DEVICE, SHEET SEPARATION METHOD, IMAGE FORMING APPARATUS AND IMAGE FORMING METHOD

[75] Inventors: Kazunobu Maekawa; Masato Yasui, both of Toyokawa, Japan

[73] Assignee: Minolta Co., Ltd., Osaka, Japan

[21] Appl. No.: 670,428

[22] Filed: Jun. 26, 1996

[30] Foreign Application Priority Data

Jun. 30, 1995 [JP] Japan ..... 7-187764

[51] Int. Cl.[6] ..... G03G 21/00

[52] U.S. Cl. ..... 399/303; 271/900

[58] Field of Search ..... 399/303, 304, 399/398, 399, 305; 271/900, 193, 307, 308, 312

[56] References Cited

U.S. PATENT DOCUMENTS

| | | | |
|---|---|---|---|
| 4,864,358 | 9/1989 | Kasahara | 399/303 |
| 5,130,758 | 7/1992 | Takeda et al. | 399/304 |
| 5,249,024 | 9/1993 | Menjo | 399/45 |
| 5,280,325 | 1/1994 | Yamada et al. | 399/303 |
| 5,287,144 | 2/1994 | Takeda | 399/303 X |
| 5,287,163 | 2/1994 | Miyashiro et al. | 399/303 |
| 5,406,358 | 4/1995 | Kimura et al. | 399/304 |
| 5,537,193 | 7/1996 | Hasegawa | 399/398 |
| 5,543,908 | 8/1996 | Suzuki | 399/398 |

FOREIGN PATENT DOCUMENTS

| | | |
|---|---|---|
| 4-307578A | 10/1992 | Japan . |
| 5-2351 | 1/1993 | Japan . |
| 6-036887 | 2/1994 | Japan . |

*Primary Examiner*—R. L. Moses

*Attorney, Agent, or Firm*—Burns, Doane, Swecker & Mathis, LLP

[57] ABSTRACT

The invention relates a sheet separation apparatus including a sheet carrying member which is capable of holding a sheet thereon, a device positioning a sheet on the surface of the sheet carrying member, a device separating the held sheet from the sheet carrying member by predetermined sheet separating power, said separating means capable of changing the sheet separating power, and a device selecting sheet separating power of the separating device according with the surface of the sheet positioned by the positioning device. The object of the invention is to provide a reliable separation of the sheet from said sheet carrying member.

17 Claims, 4 Drawing Sheets

SHEET SEPARATION DEVICE, SHEET SEPARATION METHOD, IMAGE FORMING APPARATUS AND IMAGE FORMING METHOD

BACKGROUND OF THE INVENTION

1. Field of the Invention

The present invention relates to a sheet separation device and separation method for separating a sheet from a sheet carrying member such as a transfer drum, and image forming device and image forming method using said sheet separation device. More specifically, the present invention relates to an electrophotographic image forming apparatus and image forming method provided with a duplex printing. function, and a sheet separation device and sheet separation method used in such image forming apparatus, for example, a duplex printer, duplex copier, duplex facsimile machine and the like.

2. Description of the Related Art

Image forming apparatuses of the electrophotographic type provided with a duplex printing function, e.g., duplex printer, duplex copiers, duplex facsimile machines and the like, have been proposed. These apparatuses first transfer a toner image to a first surface (front side) of a sheet as a transfer surface, then fuse said toner image to the sheet via heat or pressure, and thereafter transfer a toner image to a second surface (back side) of said sheet as a transfer surface, then fuse said toner image on the sheet in the same manner as on the first surface (front side), so as to form toner images on both sides of the printed (fixed) sheet.

Color image forming apparatuses of the electrophotographic type provided with a duplex printing function have been proposed. For example, color duplex printer, color duplex copiers, color duplex facsimile machines and the like have been proposed. In these devices, toner images of yellow (Y), magenta (M), cyan (C), and black (B) formed sequentially on the surface of a photosensitive drum are transferred so as to be overlaid one over another on a first surface (front surface) of a sheet supported on a sheet carrying member such as a transfer drum, transfer belt or the like, and thereafter said sheet is separated from said sheet carrying member and transported to a fixing device for fixing. Then, the aforesaid sheet is fed again so as to be supported on said sheet carrying member with a second surface (back surface) disposed as a transfer surface, and when said sheet arrives at a transfer position, toner images of four colors are sequentially transferred thereto so as to be superimposed one over another on said second surface in the same manner as the first surface, and subsequently said sheet is separated from said sheet carrying member and transported to a fixing device which fuses the overlaid toner image thereon, whereupon said sheet is ejected from the apparatus.

Image forming apparatuses of the electrophotographic type provided with a duplex printing function such as the above described apparatuses readily produce impaired stability during sheet transport due to trouble such as paper jams and the like.

SUMMARY OF THE INVENTION

An object of the present invention is to provide a novel and useful sheet separation device and separation method, as well as provide an image forming apparatus and image forming method using said sheet separation device.

Another object of the present invention is to provide a sheet separation device and sheet separation method for separating a sheet printed on both sides from a sheet carrying member, and an image forming apparatus and image forming method using said sheet separation device, wherein a sheet bearing a transferred toner image on its second surface (back side) can be reliably separated from said sheet carrying member such as a transfer drum or the like without impairing sheet transport stability due to trouble such as paper jams and the like.

DETAILED DESCRIPTION OF THE PREFERRED EMBODIMENTS

Figure 1:
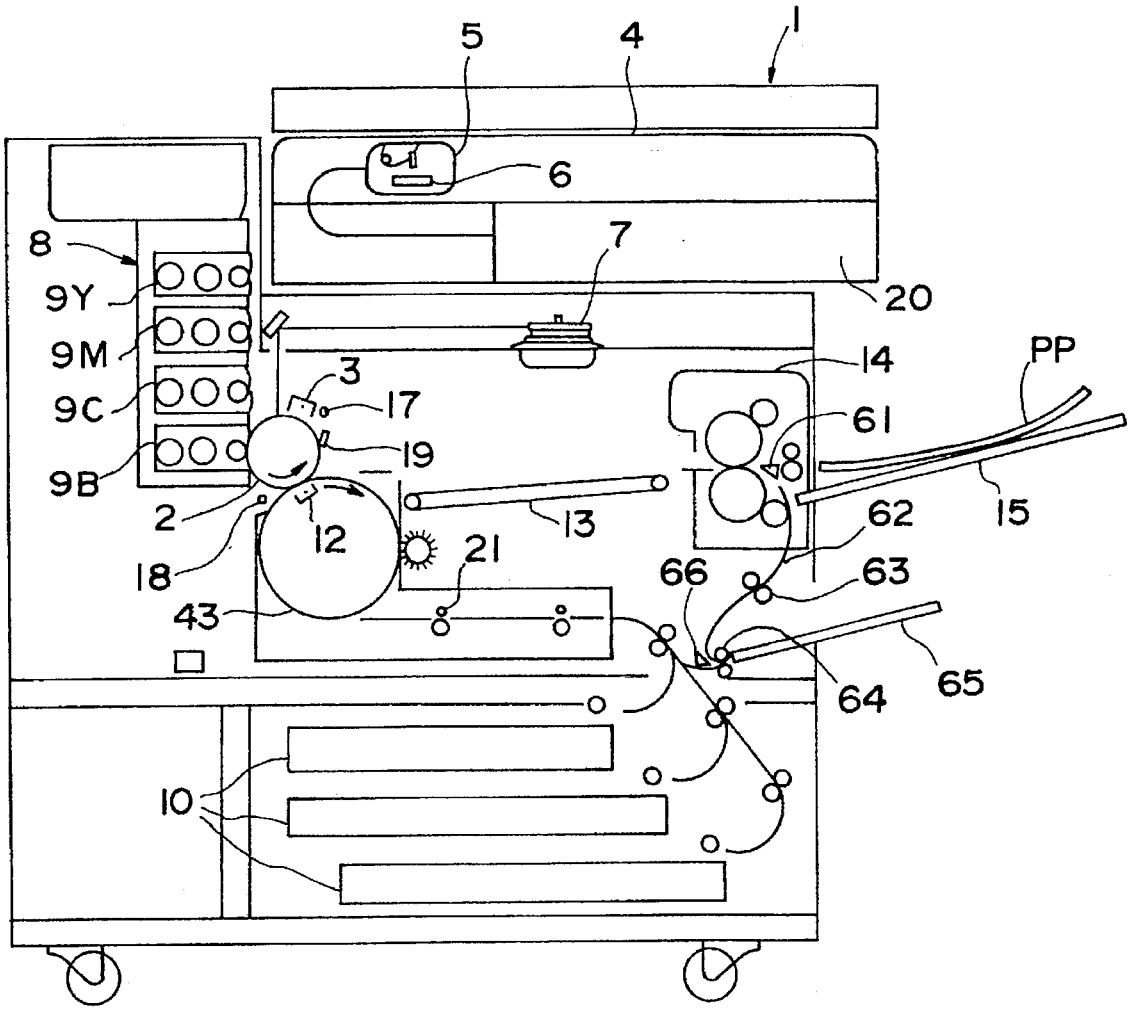
FIG. 1 shows the mechanism of an embodiment of the device.

A sheet which has been subjected to heat and pressure by a fixing device to fuse a transferred toner image tends to curl, due to the affects of heat and pressure during fixing, in such a manner that the side bearing the transferred toner image is on the interior side of said curl. This curling is due to differences in the heat shrinkage rates of the sheet and toner. The extent of such curling is particularly severe in the case of color printing wherein the overlay of toner images of four colors produces a large amount of adhered toner. For example, a maximum amount of 2.5 to 3 mmg/cm$^2$ of toner may be adhered.

In color image forming apparatuses, after toner images of yellow (Y), magenta (M), cyan (C), and black (B) formed on the surface of a photosensitive drum are transferred so as to be superimposed one over another on a sheet which is electrostatically adhered to the surface of a sheet carrying member such as a transfer drum or the like, said sheet is separated from the sheet carrying member, and transported to a fixing device which fuses the toner to the sheet. When the sheet is separated from the sheet carrying member, the electrostatic force adhering the sheet to the sheet carrying member is weakened by a separation charger, and a separation finger is inserted between the leading edge of the sheet and the surface of the sheet carrying member so as to reliably separate the sheet from said sheet carrying member.

When a sheet which has been printed on a first surface (front side) is inverted for printing on a second surface (back side), the sheet is electrostatically adhered to the sheet carrying member so as to have said first surface confronting the surface of the sheet carrying member. That is, the sheet is electrostatically adhered to the sheet carrying member such that the interior side of the curled sheet faces the surface of the sheet carrying member. Thus, there is no gap between the leading edge of the sheet and the surface of the sheet carrying member. Accordingly, when this sheet is separated form the sheet carrying member, it is difficult to insert the separation finger between the leading edge of the sheet and the surface of the sheet carrying member, which leads to inadequate separation and, as a result, produces trouble such as paper jams and the like caused by said inadequate separation.

A preferred embodiment of the present invention is an image forming apparatus that prints an image on a second side of a sheet by an electrophotographic method after first printing an image on a first side of said sheet by an electrophotographic method, said image forming apparatus comprising a holding means for adhering a sheet on an elastically deformable surface and transporting said sheet to a transfer position, separation means for separating a sheet adhered by said holding means from said holding means at a position downstream from said transfer position in the direction of sheet transport, setting means for setting the operation level of said separation means so as to increase the separation power when separating a sheet bearing a transferred toner image on its second surface so as to be greater than the separation power when separating a sheet bearing a transferred toner image on its first surface, and a drive means for driving said separation means at a set operation level.

The aforesaid separation means may be a lifting means for lifting a sheet from the surface of the sheet holding means by lifting said sheet from the side opposite the side adhered to the sheet holding means, and the aforesaid setting means may be a means for increasing the amount of lift by said lifting means when separating a sheet bearing a transferred toner image on its second side.

The aforesaid separation means may be a separation finger for separating the leading edge of a sheet by pressing downward on the surface of said holding means from the adhered side of the sheet, and said setting means may be a means for increasing the amount of downward force by said separation finger when separating a sheet bearing a transferred toner image on its second side.

The aforesaid separation means may be a discharge means which weakens the electrostatic adhesion force nu discharging the surface of the sheet holding means to which a sheet is adhered, and said setting means may be a means for increasing the discharge output level of said discharge means when separating a sheet bearing a transferred toner image on its second side.

Furthermore, the aforesaid arrangements may be used in combination.

The image to be printed may be input from or transmitted as image data from an image reader (image forming apparatus), or drive-type device such as a personal computer, communication line, network (LAN and the like), high-capacity storage media (compact disk and the like), magneto-optical media (MO), floppy disk (FD), hard disk (HD) and the like, or may be an image drawn on paper or the like. That is, the present invention is applicable to an image forming apparatus of the electrophotographic type provided with a function to print both sides of a sheet, such as color printer, monochrome printer, color facsimile machine, monochrome facsimile machine, digital color copier, digital monochrome copier, analog color copier, analog monochrome copier and the like.

The aforesaid holding means may be, for example, a transfer drum having a dielectric film wrapped around the exterior surface of a cylindrical frame member, or a transfer belt comprising a flexible endless belt formed of film or rubber which is looped around a drive roller and a driven roller.

The aforesaid separation means may be a separation finger which is inserted between the leading edge of a sheet and the surface of the holding member to separate said sheet, a lifting mechanism which lifts the leading edge of a sheet from the surface of the holding member by lifting the surface of said holding member from the interior side of the dielectric film or the like, or a separation charger which discharges to weaken the electrostatic adhesion force between a sheet and a holding means. In the description of the present invention, the "sheet" referred to pertains not only to ordinary copy sheets (plain paper), but also includes all sheets which receive printed images via an image forming apparatus of the electrophotographic type, and sheets subject to the previously mentioned disadvantage of "curling", e.g., overhead projection transparencies (OHP).

The adjustment method for setting the operation level via the setting means is determined in accordance with the type of separation means used. For example, if the separation means is a separation finger, the separation means operation level can be adjusted by adjusting the extent of downward pressure on the surface of the holding means by the tip of the separation finger to be inserted between the leading edge of the sheet and the surface of the holding means. If the separation means is a lifting mechanism, the operation level of the separation means can be adjusted by adjusting the extent of lift from the interior side of the dielectric film or the like. Furthermore, if the separation means is a separation charger, the operation level of the separation means can be adjusted by adjusting the degree of discharge.

The previously mentioned drive means controls the separation means at an operation level set by the aforesaid setting means. The preferred embodiments of the present invention are described in detail hereinafter with reference to the accompanying drawings.

Figure 2:
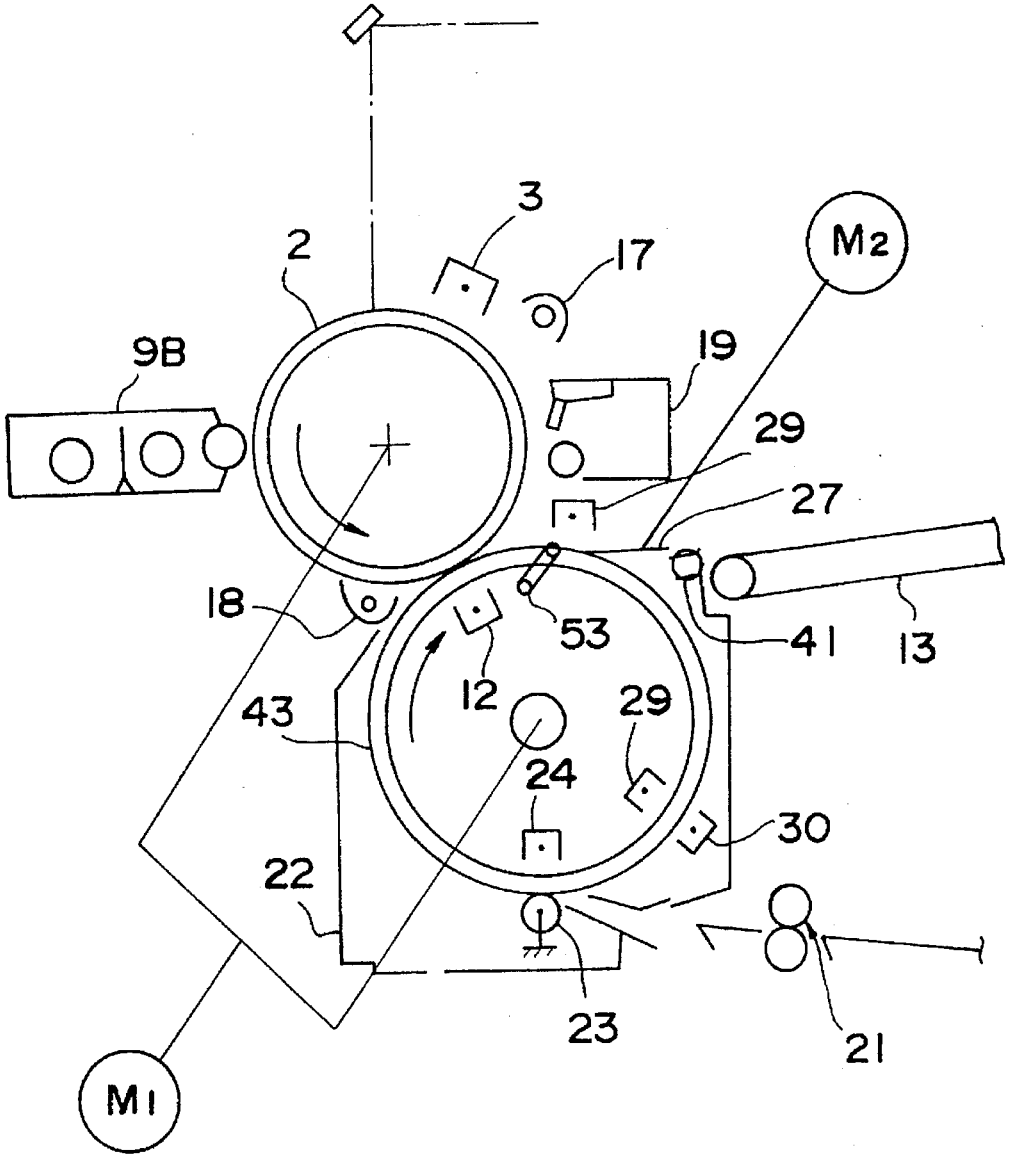
FIG. 2 shows the essential portion of the mechanism of an embodiment of the device.

(1) copying apparatus construction (FIGS. 1 and 2)

First, the construction and operation the copying apparatus are described below.

The copying apparatus of the present embodiment is a digital color duplex copying apparatus. An automatic document feeder (ADF) 1 is provided on the top of document platen 4 of the copying apparatus body.

The ADF 1, which is shown as a rectangle in the drawing which omits details of its construction, is a device capable of automatically feeding and discharging duplex documents, and has the construction and functions described below.

A document set with a first surface facing upward (e.g., first surface disposed face up, second surface face down) on a document tray is picked up from the uppermost position of the document stack and fed to a predetermined position on document platen 4 with said first surface face down thereon, and remains at said predetermined position until scanning of the first image is completed; after scanning ends said document is transported in the same direction as the feeding direction to an inversion unit provided at the end; after said document is inverted front-to-back in the inversion unit, it is again transported to the aforesaid predetermined position with a second surface face down thereon, and after scanning is completed said document is transported in the opposite direction to the feeding direction so as to again arrive at the inversion unit and is subsequently ejected from the inversion unit to a discharge tray with said second surface facing upward (i.e., first surface is face down). The mechanism and control of the ADF 1 may be any well known mechanism and control. That is, the ADF 1 is not limited to the aforesaid device, inasmuch as, for example, a document circulation feeding type device, or a device of a type without a document inverting function may be used. Naturally, when a device of a type without a document inverting function is used, a duplex document cannot be inverted front-to-back and sequentially fed automatically.

The copying apparatus body comprises an image reader unit and a printer unit.

The image reader unit converts a document stopped at a predetermined position on document platen 4 to line-by-line electrical signals by optically scanning said document via a scanner 5, and generates image data corresponding to the document image based on said electrical signals. That is, an image of reflected light is converted to electrical signal of three colors red (R), green (G), blue (B) for each pixel via a color image scanner 6 provided in scanner 5, and said electrical signals are transmitted to an image processing unit 20 for predetermined processing. The various four color density data of yellow (Y), magenta (M), cyan (C), and black (B) generated by the aforesaid process are sequentially transmitted to a laser drive circuit (FIG. 3) of laser device 7 to form an electrostatic latent image.

The laser drive circuit of laser device 7 converts the aforesaid density data to data to drive a laser diode, and said laser driving data are used to modulate the drive current supplied to laser diode LD. A laser beam emitted from the laser diode driven by the modulated drive current is directed by a well known optical system provided with a polygonal mirror, so as to scan the charged surface of a rotating photosensitive drum 2 in the axial direction of said drum (a direction perpendicular to the sheet surface in the drawing). Thus, an electrostatic latent image (charged latent image) corresponding to a document image is formed on the charged surface of photosensitive drum 2. In the case of full color image formation, this electrostatic latent image is formed in sequence for each toner color, i.e., in the sequence yellow (Y), magenta (M), cyan (C), black (B). In the case of a monochrome image, an electrostatic latent image is formed in accordance with the luminance of the document image.

Image formation by an electrophotographic process is accomplished in the printer unit.

That is, an electrostatic latent image formed on the surface of photosensitive drum 2 is developed by toner via developing unit 8 provided with developing devices 9Y, 9M, 9C, or 9B which accommodate color toner (and carrier) in accordance with said latent image, and said toner image is transferred to a sheet adhered to the surface of a transfer drum 43. In the case of a full color image, the toner images of each color yellow (Y), magenta (M), cyan (C), and black (B) are transferred to the same sheet so as to be superimposed one upon another. After the toner image is transferred, the sheet is peeled from the transfer drum 43, and transported to fixing device 14 via a suction type transport belt 13, and fixing device 14 accomplishes an image fixing process via heat and pressure. After the image fixing process, if the duplex copy mode (mode for forming various images on both sides of a sheet) has been set and the first surface (front side) of the sheet has been printed directly before, the sheet is fed through duplex path 62 so as to be inverted front-to-back, and thereafter said sheet is again adhered to transfer drum 43 and the print process is performed on the second surface (back side). When a one-side mode (mode for forming an image on only one side of the sheet) or when the second surface of a sheet has been printed directly before, the sheet is ejected from the copying apparatus body to discharge tray 15. The ejection of the sheet may occur directly, or the sheet may be inverted front-to-back by switching branch wedge 61.

The various mechanisms of the printer unit are described below.

Provided sequentially around the periphery of photosensitive drum 2 which rotates in the arrow direction are a charger 3 for uniformly charging the surface of photosensitive drum 2, developing unit 8 provided with four developing devices 9Y, 9M, 9C, 9B for developing via toner the electrostatic latent image formed by a laser beam on said uniformly charged surface, transfer drum 43 which rotates in the arrow direction and supports a sheet for receiving the transferred toner image developer by a selected developing device, cleaner 19 for removing residual toner from photosensitive drum 2, and eraser 17 for eliminating residual charge from the surface of photosensitive drum 2 via optical exposure. Reference number 18 refers to a pretransfer eraser.

The four developing devices 9Y, 9M, 9C, 9B accommodate yellow (Y), magenta (M), cyan (C), and black (B) toner, respectively. These developing devices are sequentially selected, a selected developing device is set at a developing position, and the latent image formed on the surface of photosensitive drum 2 is sequentially developed as a toner image in accordance with the toner color within said developing device. Developing device selection is accomplished by elevating developing unit 8. In the drawing, developing device B which accommodates black toner (B) has been selected. In the present embodiment, developing device 8 is an elevator type device, but a rotary or other type device may be used.

Transfer drum 43 is rotated in the arrow direction in synchronization with photosensitive drum 2, as shown in FIG. 2. The diameter ratio of photosensitive drum 2 to transfer drum 43 is 1:2. The reason for this ratio is to prevent the occurrence of color dislocation due to shifting of the photosensitive drum 2, shifting of transfer drum 43, or variation in the engagement of gears. That is when constructed with the aforesaid diameter ratio, transfer shifting occurs identically for each color toner even when the aforesaid shifting or oscillation occurs, such that color dislocation is prevented as a result. When constructed with the aforesaid diameter ratio and when the full color mode is selected, a one-sided copy can be obtained in four rotations of the transfer drum 43 and 8 rotations of the photosensitive member 2. The rotation of the transfer drum 43 and photosensitive drum 2 is accomplished by a motor M1.

A dielectric film having a thickness about 150 μm is anchored to the cylindrical peripheral surface of transfer drum 43. This dielectric film may be formed of, for example, polyvinylidene fluoride (PVDF), polycarbonate (PC) or the like.

The interior and vicinity of transfer drum 43 is provided with a charger 24 for supplying a positive charge to electrostatically adhere a sheet, grounded conductive roller 23 provided so as to hold the film on the surface of transfer drum 43 at a position opposite said charger 24, transfer drum support frame 22 provided so as to be rotatable about a shaft 41 so as to normally maintain a distance of 0.1 to 0.5 mm between transfer drum 343 and photosensitive drum 2, transfer charger 12 for supplying a charge to electrostatically transfer a toner image form the surface of photosensitive drum 2 to a sheet, separation charger (separation means) 29 for discharging the charge which adheres the sheet, separation finger (separation means) 27 for separating the leading edge of the sheet from transfer drum 43, lifting member (separation means) 53 for lifting the sheet from the film by lifting the film on the circumference of transfer drum 43 from the interior side directly in front of the sheet separation position, and dischargers 29 and 30 for discharging the residual charge remaining on the interior and exterior surfaces of transfer drum 43 by an AC output. Although only a single charger 29 is provided as a separation charger in the drawing, is provided with another separation charger at a position so as to hold the film therebetween, such that said other charger may function to diminish the electrostatic adhesion force of the sheet and the dielectric film by an AC output to said other separation charger, and function to prevent airborne dispersion of the transferred toner image by discharging the sheet and preventing discharge in accordance with separation when the sheet is separated from transfer drum 43. In the present embodiment, the aforesaid two functions are performed by a single separation charger 29.

Figure 3:
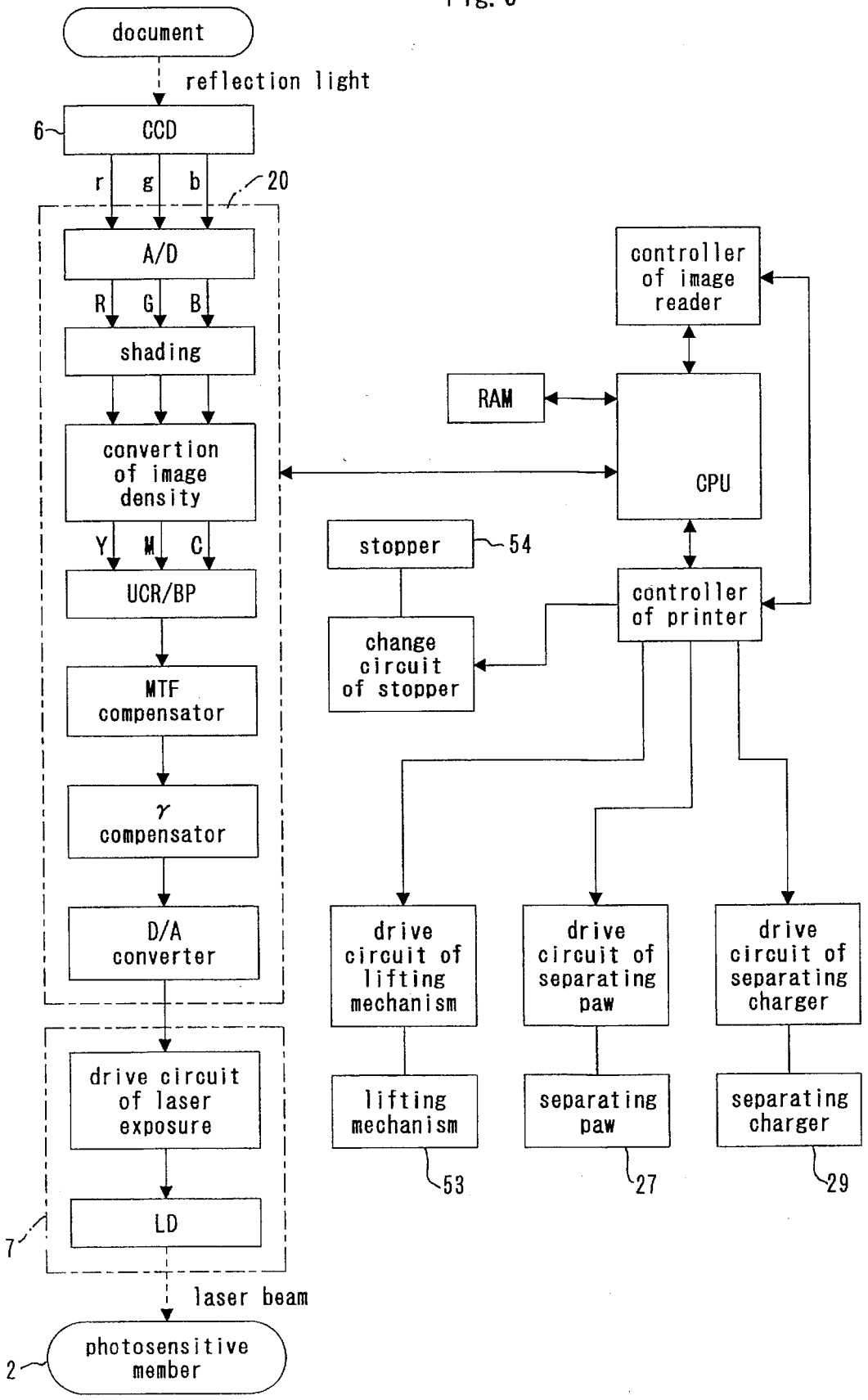
FIG. 3 is a block diagram showing the essential portion of the electrical construction of an embodiment of the device.

During the image forming operation, a sheet output from one of three sheet trays 10 arrives at timing roller 21, and forms a loop while in contact with said timing roller 21 so as to correct skewing of the sheet. Thereafter, in synchronization with photosensitive drum 2, the sheet is fed between charger 24 which is connected to an HV circuit (high voltage power circuit; FIG. 3) and the grounded conductive roller 23 which confronts charger 24, so as to be held between said roller 23 and the surface (dielectric film) of transfer roller 43 and electrostatically adhered to said dielectric film.

The sheet is transported in the arrow direction while adhered to transfer drum 43, and when said sheet arrives at the transfer position (a position between transfer charger 12 and photosensitive drum 2), a transfer charge is supplied to the sheet on the surface of transfer drum 43 from transfer charger 12 connected to the transfer HV circuit (high voltage power circuit; FIG. 3). Thus, the toner image developed on the photosensitive drum 2 by one or more of the four developing devices 9Y, 9M, 9C, or 9B is electrostatically transferred to the sheet.

In the case of color printing the four toner images of yellow (Y), magenta (M), cyan (C), and black (B) must be combined, such that each time the sheet arrives at the previously mentioned transfer position, a toner image of a selected color is formed on the surface of photosensitive drum 2, and said toner image is transferred to the sheet as previously described. In this example, the yellow (Y) toner image is the first to be transferred.

After the yellow (Y) toner image has been transferred, the sheet is rotated together with the transfer drum 43 while adhered to said transfer drum 43 so as to pass the positions of the non-operating separation charger 29, non-operating (retracted position) separation finger 27, non-operating (retracted position) lifting mechanism 53, non-operating (non-contact) cleaner, non-operating dischargers 29 and 30, and non-operating charger 24 and arrive again at the transfer position. The reason the aforesaid components are in a non-operating (non-contact) state, is to avoid disturbing the yellow (Y) toner image previously transferred to the sheet. The conductive charger 23 disposed at a position confronting charger 24 is originally in a state of non-contact, and poses no threat of disturbing the transfer image.

This time when the sheet returns to the transfer position a magenta (M) toner image is transferred and combined with the aforesaid yellow (Y) toner image. Thereafter, the sheet is again transported in rotation as previously described until again arriving at the transfer position, whereupon a cyan (C) toner image is transferred to the sheet, then the sheet is again transported in rotation until again arriving at the transfer position, whereupon a black (B) toner image is transferred to the sheet in a similar manner.

When the transfer and combination of the toner images of the four colors ends, the sheet adhered to the transfer drum 43 is separated therefrom by weakening the electrostatic adhesion force via a discharge from separation charger 29, and the leading edge of the sheet is lifted from the surface of the dielectric film by lifting the dielectric film on transfer drum 43 from the interior side of the film via lifting mechanism 53, and inserting the tip of separation finger between the leading edge of the sheet and the surface of the dielectric film. In this case, the transfer process ends relative to the first surface of the sheet. The output of separation charger 29, amount of lift of lifting mechanism 53, and amount of pressing down of dielectric film by separation finger 27 may be normal levels insofar as sheet curling can be ignored.

Thus, the sheet separated from the transfer drum 43 is fed to fixing device 14 by a transport belt 13 provided with a suction means, and is subjected to an image fixing process via heat and pressure provided by said fixing device 14.

After the image fixing process, if a one-side mode or if the second surface of a sheet has been printed directly before, the sheet is ejected from the copying apparatus body to discharge tray 15 guided by the top surface of branch wedge 61 provided as shown in the drawing. In the drawing, the sheets PP stacked on discharge tray 15 are disposed with the side bearing the formed image on the interior side of the curl resulting from a one-side copy. Branch wedge 61 can be switched so as to guide the sheet by the left surface of said wedge 61 in the drawing into duplex path 62, and thereafter switching the branch wedge 61 is again switched in conjunction with the reversal of the rotation direction of transport roller 63 so as to guide the sheet with the left surface of said wedge 61 in the drawing, thus controlling the ejection of the sheet from the apparatus to discharge tray 15. In this case, the sheet is inverted front-to-back when discharged.

On the other hand, when a first surface of a sheet has been printed directly before and a duplex copy mode has been set, the sheet is guided by the left surface of branch wedge 61 which has been switched from the position illustrated in the drawing, so as to be inserted into duplex path 61 and arrive at inversion tray 65 via transport roller 63 and inversion roller 64. The rotational direction of inversion roller 65 is reversed directly before the trailing edge of the sheet passes thereby, and the switching member 66 having an inlet to inversion tray 65 is switched. Thus, the sheet is fed into the sheet transport path leading to the aforesaid timing roller 21. At this time, the sheet is reversed front-to-back. The sheet is again electrostatically adhered to transfer drum 43, and this time the transfer process is performed on the second surface of the sheet. Accordingly, at this time the first surface of the sheet (the side bearing an image) is adhered so as to confront the dielectric film of transfer drum 43.

Then, when all transfer processes are completed for the second surface of the sheet (i.e., transfer of four colors of toner Yellow (Y), magenta (M), cyan (C), black (B)), the sheet adhered to transfer drum 43 is separated form the dielectric film on the surface of transfer drum 43 by the cooperative actions of charger 29, lifting mechanism 53, and separation finger 27. In this instance, the transfer to the second surface of the sheet is completed, and because a sheet having a large amount of curl is adhered to transfer drum 43, a larger current is supplied to separation charger 29 than is supplied after the first surface transfer of the sheet ends, lifting mechanism 53 is controlled so as to apply more lift than is applied after the first surface transfer of the sheet ends, and separation finger 27 is controlled so as to apply more downward pressure than is applied after the first surface transfer of the sheet ends. By means of such controls, the sheet, which is electrostatically adhered so as to have no gap along the surface f the transfer drum 43, can be reliably separated from the dielectric film on the surface of said transfer drum 43. Although, in the present embodiment, the separation charger 29, lifting mechanism 53, and separation finger 27 are all operated at a high operation level than for separation after the first surface transfer of the sheet ends, it is to be understood that any one of the separation means, or any optional two separation means may be controlled so as to achieve a certain degree of effectiveness.

Since the dielectric film may be damaged and result in incomplete transfer, and the impact when lifting may cause airborne scattering of unfixed toner when the lift amount of lifting mechanism 53 is too great, the amount of lift is controlled to a minimum limit when separating a sheet bearing a transferred image on a first surface. Similar control is exerted on the downward pressure of separation finger 27 on the dielectric film. The output of separation charger 29 is controlled to a minimum limit when separating a sheet bearing a transferred image on the first surface because when the output of separation charger 29 is too great, the force holding the toner on the sheet is reduced, and there is concern that untransferred toner is subject to airborne dispersion. For these reasons, the output of separation charger 29 may be increased at the leading edge area of a sheet because the scooping action of the separation finger is adequate even when separating a sheet bearing a transferred toner image on a second surface.

Details of lifting mechanism 53 and the construction for switching the amount of lift are described below.

As previously mentioned, the controls which increase the discharge power to supply a large current to separation charger 29, widen the gap between the dielectric film and the sheet by increasing the amount of downward pressure of separation finger 27, and increase the amount of lift of the leading edge of the sheet from the dielectric film by increasing the amount of lift exerted by lifting mechanism 53 are realized by transmitting various control signals to the separation HV (high voltage) circuit, separation finger drive circuit, and lifting mechanism drive circuit, so as to operate corresponding members via said circuits.

The printer control unit executes sequence controls of the operation of various members required for the printing process in synchronization with the image reader unit and image processing unit 20 via communications with a central processing unit (CPU), and transmits the aforesaid control signals with a suitable timing determined by said controls.

Figure 4A:
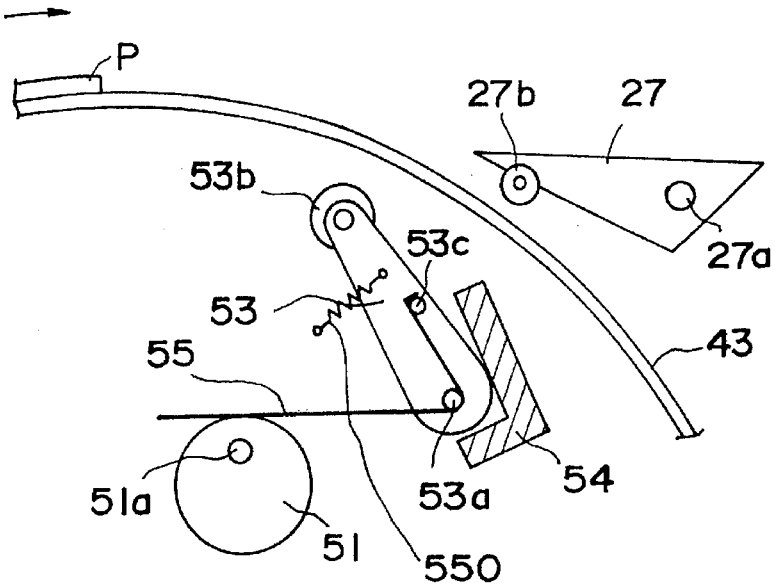
FIGS. 4(*a*), 4(*b*), 4(*c*) are section views showing the operation of the lifting mechanism of an embodiment of the device.
Figure 4B:
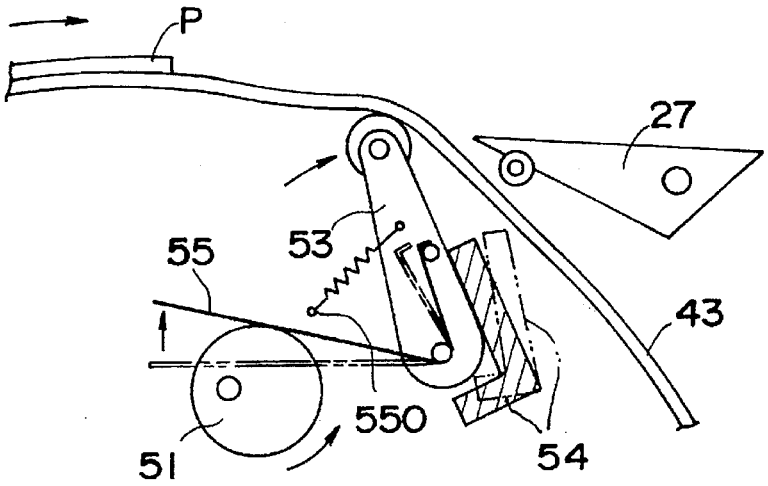
Figure 4C:
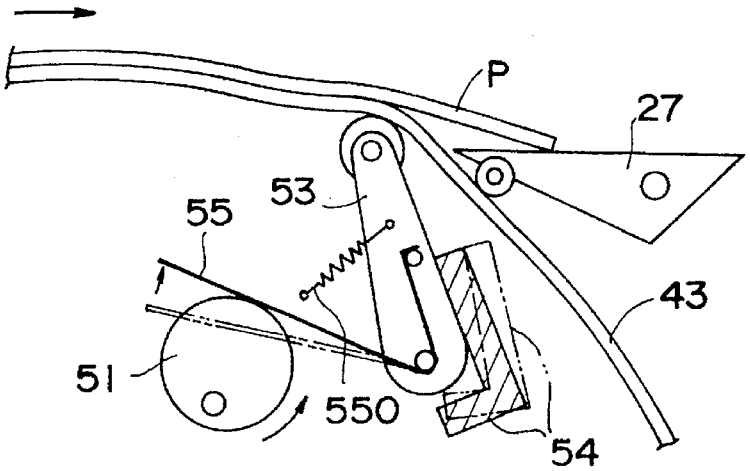

(2) Construction of Lifting Member 53 (FIG. 4)

The mechanism of lifting member 53 is described in detail below.

In FIG. 4, reference number 51 refers to a cam, which is driven in rotation around shaft 51*a* via a suitable drive source. Lifting member 53 is supported by shaft 51*a* so as to be freely oscillatable, and the tip of lifting member 53 is provided with a roller 53*b*. Reference number 54 refers to a detent; when lifting member 53 rotates in a clockwise direction in the drawing and attains the position of detent 54, lifting member 53 is halted at said position by detent 54. Detent 54 is normally provided at the position shown in the drawing, by is positioned as indicated by the dashed lines in FIGS. 4(*b*) and 4(*c*) when a sheet bearing a transferred image on the second surface is separated from dielectric film (transfer drum surface) 43. The amount of rotation of lifting member 53 can be controlled by the aforesaid switching of the set position. That is, the amount of lifting of dielectric film (transfer drum surface) 43 by lifting member 53 can be increased.

Reference number 55 refers to a spring, stretched between the cam surface of cam 51 and a pin 53*c* protruding integratedly from lifting member 53, and exerts a force to rotate lifting member 53 in a clockwise direction by forcing in an upward direction via the rotation f cam 51 in the arrow direction, as shown in FIGS. 4(*b*) and 4(*c*).

The operation of lifting member 53 is described below.

The cam 51 is rotated in the arrow direction with coincident timing when the leading edge of a sheet P electrostatically adhered to dielectric film (transfer drum surface) 43 and transported therewith attains a position directly in front of lifting member 53. Thus, lifting member 53 is lifted by spring 55 and rotates in a clockwise direction, such that roller 53*b* on the tip of lifting member 53 lifts dielectric film 43. FIG. 4(*b*) shows this state.

Although the rotation of lifting member 53 is halted by contact with detent 54, the force exerted on lifting member 53 by spring 55 is strengthened after lifting member 53 is stopped by contact with detent 54 such that lifting member 53 is forced in a clockwise direction by the force of upward rotation of resistance to dielectric film 43 because spring 44 is raised by the cam surface due to the rotation of cam 51 in the arrow direction. Therefore, lifting member 53 is strongly lifted to detent 54 and is held in a stable state at said position. Accordingly, the amount of lift is maintained at a set value. FIG. 4(*c*) shows this state. The tip of separation finger 27 can be inserted between dielectric film 43 and sheet P because the leading edge of sheet P os lifted from dielectric film 43. Therefore, sheet P can be reliably separated from dielectric film 43.

In the present embodiment, there are two set values for the amount of lift corresponding to the two positions of detent 54 (solid line position and dashed line position) detent 54 is set at the solid line position in the drawing when a sheet bearing a transferred image on a first surface is separated, and is set at the dashed line position in the drawing when a sheet bearing a transferred image on a second surface is separated. Accordingly, the amount of lift of dielectric film 43 is at a normal level when a sheet bearing a transferred image on a first surface is separated, and is at a greater than normal level when a sheet bearing a transferred image on a second surface is separated.

When cam 52 is rotated in the arrow direction from the state shown in FIG. 4(*b*), the lifting force exerted on lifting member 53 by spring 455 is reduced. Lifting member 53 is returned to the origin position shown in FIG. 4(*a*) by the action of return spring 550.

In this way the lifting force exerted by spring 55 on lifting member 53 changes in accordance with the angle of rotation of cam 51. That is, the action of the spring is initially light, but is stronger in the latter half. The roller 53*b* of lifting member 53 makes light contact with dielectric film 43, and is held in said state by stronger force after contact. Therefore, dielectric film 43 oscillates during contact, to prevent disadvantageous disruption of the unfixed image transferred onto sheet P.

Although the preceding describes a mechanism which operates a lifting member using a cam mechanism, and switches the amount of lift by setting the position of detent 54, the present invention is not limited to said mechanism. That is, the present invention can be realized if the mechanism is such that the surface of the sheet holding member such as a transfer drum, transfer belt or the like, is lifted from its interior side, and the amount of lift is switched between two stages.

In FIG. 4, separation finger 27 is supported so as to be oscillatable about shaft 27*a*, and separation finger 27 is oscillated by a suitably selected drive motor M2 to lift dielectric film 43 via contact on its exterior side from a roller 27*b* at the tip of separation finger 27 so as to widen the gap between the leading edge of sheet P and dielectric film 43. The amount of this lifting is set in accordance with whether or not a sheet bearing a transferred image on a first surface is separated or a sheet bearing a transferred image on a second surface is separated, i.e., the oscillation angle of separation finger 27 is switchable between two stages as in the previously described case of lifting member 53. The mechanism for switching between the two stages, and the mechanism for oscillating separation finger 27 may be a well known mechanism or a mechanism similar to that of lifting member 53.

(3) Image Processing (FIG. 3)

The image processing unit 20 is described below

Various RGB image signals converted from electrical signal read by color image sensor (CCD) 6 are converted to yellow (Y), magenta (M), cyan (C), and black (B) density data by image processing unit 20, and sequentially transmitted to the laser drive circuit of laser generator 7. Image processing unit 20 is provided with an A/D converter, shading correction unit, density conversion unit, UCR/BP unit, MTF correction unit, gamma correction unit, and D/A converter.

The red (r), green (g), and blue (b) image signals received from CCD 6 by the A/D converter are converted to 81 bit (256 halftones) image data (red R, green G, blue B), these image data are subjected to shading correction by the shading correction unit to eliminate light quantity irregularities in the main scan direction by the exposure lamp, reflection irregularities caused by the reflection mirrors, and effects caused by sensitivity differences among the elements of CCD 6. Then, yellow (Y), magenta (M), cyan (C), and black (B) density data are generated from the red R, green G, and blue B data by the density conversion unit. That is, data corresponding to the density of a document are generated by logarithmic conversion of data corresponding to reflected light intensity of a document per visual characteristics. Then, undercolor removal processing and BP processing for generating density data corresponding to black B are accomplished by the UCR/BP unit.

When yellow (Y), magenta (M), cyan (C), and black (B) density data are generated, these data are sequentially subjected to predetermined processing and output. That is, a smoothing process to prevent the occurrence of moire reticulation, and edge enhancing process to prevent edge loss are performed by the MTF correction unit, and after halftone correction by the gamma correction unit, the data are converted to analog density signals by the D/A converter. Thus, the laser diode is driven to form electrostatic latent images corresponding to yellow (Y), magenta (M), cyan (C), and black (B) on the surface of photosensitive drum 2. Furthermore, the formed electrostatic latent images are subjected to the previously described developing process to as to be developed as toner images, which are adhered to transfer drum 43 and moved to a transfer position at which the toner image is transferred to sheet P.

Although the present embodiment has been described in terms of copying a color duplex document using a full color digital copying apparatus, it is to be noted that the present invention is not limited to this embodiment and may be modified as described below.

For example, a first image and a second image may be images on different documents.

The first image and second image may be input from or transmitted as image data from an image reader (image forming apparatus), or drive type device such as a personal computer, communication line, network (LAN and the like), high capacity storage media (CD, MO, WO, FD, HD). That is, the present invention is applicable to an image forming apparatus of the electrophotographic type provided with a function for duplex printing and which transports a sheet adhered to a sheet carrying member, such as color printer, monochrome printer, color facsimile machine, monochrome facsimile machine, digital color copier, digital monochrome copier, analog color copier, analog monochrome copier and the like.

In the previously described embodiment, a sheet can be reliably separated from a sheet carrying member even after an image has been transferred to a second surface thereof producing a large curl in said sheet, because when said sheet is separated from the surface of the sheet carrying member after an toner image has been transferred, said separation is accomplished with a greater separation force when separating said sheet after a toner image is transferred to a second surface than the separation force when separating a sheet after a toner image is transferred to a first surface. Therefore, troubler such as paper jams are prevented and sheet transporting stability is improved.

The present invention is not limited to the previously described embodiments and may be variously modified by those skilled in the art insofar as such modifications do not depart from the scope of the invention.

What is claimed is:

1. A sheet separation device comprising:

a sheet carrying member which is capable of holding a sheet thereon;

means for positioning a sheet on the surface of the sheet carrying member;

means for separating the held sheet from the sheet carrying member by predetermined sheet separating power, said separating means being capable of changing the sheet separating power; and means for selecting sheet separating power of the separating means according with the surface of the sheet positioned by the positioning means.

2. The device of claim 1 wherein the sheet carrying member includes an elastic film which holds the sheet thereon, the separating means separates the sheet from the sheet carrying member by lifting the elastic film for curling the sheet in order to reduce the holding between the sheet and the sheet carrying member, and the selecting means selects the sheet separating power by setting a lifting length of the elastic film which is lifted by the separating means.

3. The device of claim 1 wherein the separating means includes a separating paw which is contact with the surface of the sheet carrying member in order to tear off the sheet from the sheet carrying member, and the selecting means selects the sheet separating power by setting the contact pressure between the paw and the surface of the sheet carrying member.

4. The device of claim 1 wherein the separating means separates the sheet from the sheet carrying member by charging the sheet in order to reduce the holding between the sheet and the sheet carrying member, and the selecting means selects the sheet separating power by setting a charging power of the charge.

5. An image forming apparatus comprising:

means for forming a toner image onto a toner image carrier;

a sheet carrying member which is capable of holding a sheet thereon;

first positioning means for positioning a sheet on the surface of the sheet carrying member;

means for transferring the toner image from the toner image carrier to the surface of the sheet held on the sheet carrying member;

means for separating the held sheet from the sheet carrying member by a first sheet separating power, said separating means being capable of changing the sheet separating power;

second positioning means for positioning the separated sheet on the surface of the sheet carrying member, the toner image being contact with the surface of the sheet carrying member; and means for changing the sheet separating power so that the sheet, which is positioned by the second positioning means, is separated from the sheet carrying member by a second separating power which is larger than the first separating power.

6. The image forming apparatus of claim 5 wherein the sheet carrying member includes an elastic film which holds the sheet thereon, the separating means separates the sheet from the sheet carrying member by lifting the elastic film for curling the sheet in order to reduce the holding between the sheet and the sheet carrying member, and the selecting means selects the sheet separating power by setting a lifting length of the elastic film which is lifted by the separating means, said selecting means setting the lifting length so that the lifting length of the second separating power is larger than that of the first separating power.

7. The image forming apparatus of claim 5 wherein the separating means includes a separating paw which is contact with the surface of the sheet carrying member in order to tear off the sheet from the sheet carrying member, and the selecting means selects the sheet separating power by setting the contact pressure between the paw and the surface of the sheet carrying member, said selecting means setting the contact pressure so that the contact pressure of the second separating power is larger than that of the first separating power.

8. The image forming apparatus of claim 5 wherein the separating means separates the sheet from the sheet carrying member by charging the sheet in order to reduce the holding between the sheet and the sheet carrying member, and the selecting means selects the sheet separating power by setting a charging power of the charge, said selecting means setting the charging power so that the charging power of the second separating power is larger than that of the first separating power.

9. The image forming apparatus of claim 5 wherein forming means forms the toner image on the sheet, said toner image comprising a plurality of color-toner images which are superposed therewith.

10. A sheet separating method comprising the steps of:

positioning a sheet on the surface of a sheet carrying member, said sheet carrying member including an elastic film which holds the sheet thereon;

separating the held sheet from the sheet carrying member by predetermined sheet separating power; and selecting sheet separating power of the separating step according with the surface of the sheet which is positioned in the positioning step.

11. The sheet separating method of claim 10 wherein the elastic film is lifted for curling the sheet in order to reduce the holding between the sheet and the sheet carrying member in the separating step, and the sheet separating power is settled by setting a lifting length of the elastic film in the selecting step.

12. The sheet separating method of claim 10 wherein the sheet is separated from the sheet carrying member by a paw which is contact with the surface of the sheet carrying member in order to tear off the sheet from the sheet carrying member in the separating step, and the sheet separating power is settled by setting the contact pressure between the paw and the surface of the sheet carrying member in the selecting step.

13. The sheet separating method of claim 10 wherein the sheet separated from the sheet carrying member by charging the sheet in order to reduce the holding between the sheet and the sheet carrying member in the separating step, and the sheet separating power is settled by setting a charging power of the charge.

14. An image forming method comprising the steps of:

forming a toner image onto a toner image carrier;

first positioning a sheet on the surface of a sheet carrying member;

transferring the toner image from the toner image carrier to the surface of the sheet held on the sheet carrying member;

separating the held sheet from the sheet carrying member by a first sheet separating power;

second positioning the separated sheet on the surface of the sheet carrying member, the toner image being contact with the surface of the sheet carrying member; and changing the sheet separating power so that the sheet, which is positioned by the second positioning step, is separated from the sheet carrying member by a second separating power which is larger than the first separating power.

15. The image forming method of claim 14 wherein the elastic film is lifted for curling the sheet in order to reduce the holding between the sheet and the sheet carrying member in the separating step, and the sheet separating power is settled by setting a lifting length of the elastic film in the selecting step, said lift of the second separating power being larger than that of the first separating power.

16. The image forming method of claim 14 wherein the sheet is separated from the sheet carrying member by a paw which is contact with the surface of the sheet carrying member in order to tear off the sheet from the sheet carrying member in the separating step, and the sheet separating power is settled by setting the contact pressure between the paw and the surface of the sheet carrying member in the selecting step, said contact pressure of the second separating power being larger than that of the first separating power.

17. The image forming method of claim 14 wherein the sheet separated from the sheet carrying member by charging the sheet in order to reduce the holding between the sheet and the sheet carrying member in the separating step, and the sheet separating power is settled by setting a charging power of the charge, said charging power of the second separating power being larger than that of the first separating power.

* * * * *